US009309758B2

(12) United States Patent
Corre et al.

(10) Patent No.: US 9,309,758 B2
(45) Date of Patent: Apr. 12, 2016

(54) SYSTEM AND METHOD FOR DETERMINING MECHANICAL PROPERTIES OF A FORMATION

(71) Applicant: Schlumberger Technology Corporation, Sugar Land, TX (US)

(72) Inventors: Pierre-Yves Corre, Amiens (FR); Jean-Louis Pessin, Amiens (FR); Julian Pop, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 339 days.

(21) Appl. No.: 13/801,475

(22) Filed: Mar. 13, 2013

(65) Prior Publication Data

US 2014/0166275 A1 Jun. 19, 2014

Related U.S. Application Data

(60) Provisional application No. 61/738,825, filed on Dec. 18, 2012.

(51) Int. Cl.
*E21B 43/26* (2006.01)
*E21B 33/124* (2006.01)
*E21B 49/00* (2006.01)

(52) U.S. Cl.
CPC ..... *E21B 43/26* (2013.01); *E21B 33/1243* (2013.01); *E21B 49/006* (2013.01)

(58) Field of Classification Search
CPC ..... E21B 43/26; E21B 49/006; E21B 49/008; E21B 33/1243; E21B 33/124; E21B 33/1246; E21B 33/1277; E21B 49/081; E21B 49/10
See application file for complete search history.

(56) References Cited

U.S. PATENT DOCUMENTS

| | | | | |
|---|---|---|---|---|
| 2,301,624 | A * | 11/1942 | Holt | 166/100 |
| 4,779,681 | A * | 10/1988 | York | 166/308.1 |
| 5,295,393 | A * | 3/1994 | Thiercelin | 73/152.51 |
| 5,353,637 | A * | 10/1994 | Plumb et al. | 73/152.17 |
| 7,277,796 | B2 | 10/2007 | Kuchuk et al. | |
| 7,591,312 | B2 | 9/2009 | Johnson et al. | |
| 8,091,634 | B2 | 1/2012 | Corre et al. | |
| 2006/0016593 | A1 * | 1/2006 | Gambier | 166/250.07 |
| 2008/0295588 | A1 * | 12/2008 | van Zuilekom et al. | 73/152.26 |
| 2010/0122812 | A1 * | 5/2010 | Corre et al. | 166/250.01 |
| 2012/0111559 | A1 * | 5/2012 | Deady et al. | 166/250.1 |
| 2013/0098621 | A1 * | 4/2013 | Hallundbæk et al. | 166/308.1 |

OTHER PUBLICATIONS

International Search Report and the Written Opinion for International Application No. PCT/US2013/031406 dated Aug. 27, 2013.

* cited by examiner

*Primary Examiner* — Blake Michener
*Assistant Examiner* — Kipp Wallace
(74) *Attorney, Agent, or Firm* — Kenneth L. Kincaid

(57) ABSTRACT

A method and/or a system determines mechanical properties of a fluid-bearing formation. One or more packers may be used to measure and/or collect data regarding mechanical properties of a formation. The formation characteristics may be, for example, the stability of the formation, design parameters for frac-pack/gravel-pack operations, and sand production. The packer may expand within a wellbore of a formation until enough pressure is applied to fracture a wall of the wellbore. Before, during and/or after the fracturing of the wall, multiple measurements may be taken by the packer. After fractures are initiated, fluid may be pumped into and/or drawn from the formation using drains disposed on the packer. Additional packers may be used above and/or below the packer for isolating intervals of the wellbore.

19 Claims, 6 Drawing Sheets

SYSTEM AND METHOD FOR DETERMINING MECHANICAL PROPERTIES OF A FORMATION

CROSS-REFERENCE TO RELATED APPLICATIONS

The present application claims priority to U.S. Provisional Patent Application No. 61/738,825 filed Dec. 18, 2012, the entirety of which is incorporated by reference.

FIELD OF THE INVENTION

The present disclosure generally relates to evaluation of a subterranean formation. More specifically, the present disclosure relates to a packer tool for determining mechanical properties of a fluid-bearing formation.

BACKGROUND INFORMATION

For oil and gas exploration, information about subsurface formations that are penetrated by a wellbore is necessary. Measurements are essential to predicting production capacity and production lifetime of a subsurface formation. Collection and sampling of underground fluids contained in subterranean formations are well known. Moreover, testing of a formation may provide valuable information regarding the properties of the formation and/or the hydrocarbons associated therewith. In the petroleum exploration and recovery industries, for example, samples of formation fluids are collected and analyzed for various purposes, such as to determine the existence, composition and producibility of subterranean hydrocarbon fluid reservoirs. This aspect of the exploration and recovery process is crucial to develop exploitation strategies and impacts significant financial expenditures and savings.

A variety of packers are used in wellbores to isolate specific wellbore regions. A packer is delivered downhole on a tubing string or wireline, and a packer sealing element is expanded against the surrounding wellbore wall to isolate a region of the wellbore. The outer flexible skin or sealing layer of the sealing element is typically a uniformly-surface, cylindrical layer of rubber/elastomer.

Typically, a packer is restricted to drawing sample fluid from the formation for testing. However, the drawing of fluid, in and of itself, may not be sufficient for determining mechanical properties of the formation. Typical packer operation does not involve setting, at the essentially the same time and location, stresses in the formation near the wellbore and fluid flow rate through the formation wall. Moreover, it is not possible to measure the formation wall displacement at a location where stress is applied on the formation wall, while still permitting simultaneous flow into or from the formation at essentially the same location. Therefore, a method and/or system is desired for using a packer to determine mechanical properties of a formation, and to measure mechanical properties as a function of fluid flow and/or pressure.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

Aspects generally relate to a method and apparatus for determining formation characteristics. One or more packers may be used to measure and/or collect data regarding mechanical properties of a formation. The formation characteristics determined, may be, for example, the stability of the formation, design parameters for frac-pack/gravel-pack operations, and sand production.

The packer may expand within a wellbore of a formation until enough pressure is applied to fracture a wall of the wellbore. Before, during and/or after the fracturing of the wall, multiple measurements may be taken by the packer. After fractures are initiated, fluid may be pumped into and/or drawn from the formation using drains disposed on the packer. Additional packers may be used above and/or below the packer for isolating intervals of the wellbore.

Figure 1:
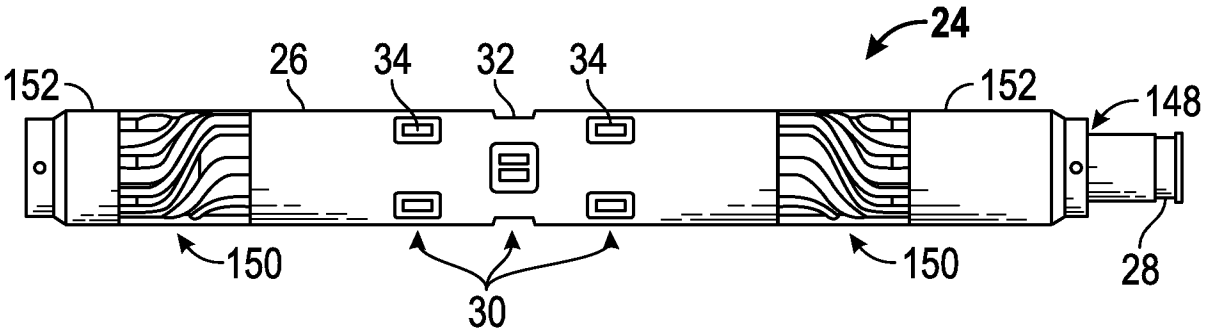
FIG. 1 (Prior Art)
FIGS. 1 and 2 generally illustrate a typical packer system of the prior art.

Referring now to FIG. 1, one embodiment of a typical packer assembly 20 of the prior art is illustrated as deployed in a wellbore. In this embodiment, the packer assembly 20 has an inflatable single packer 24 having an outer flexible skin 26 formed of expandable material, e.g. a rubber material, which allows for inflation of the packer 24. The outer flexible skin 26 is mounted around a packer mandrel 28 and has openings for receiving drains 30. By way of example, the drains 30 may have one or more sampling drains 32 positioned between guard drains 34. The drains 30 are connected to corresponding flow lines 36 for transferring fluid received through the corresponding drains 30. The flow lines 36 connected to the guard drains 34 may be separated from the flow lines 36 connected to the sample drains 32.

The outer flexible skin 26 is expandable in a wellbore to seal with a surrounding wellbore wall. The single packer 24 has an inner inflatable bladder 148 disposed within the outer flexible skin 26. By way of example, the inner bladder 148 may be selectively expanded by introducing fluid via the interior packer mandrel 28. Additionally, the packer 24 has a pair of mechanical fittings 150 that may have fluid collectors 152 coupled with the flow lines 36. The mechanical fittings 150 are mounted around the inner mandrel 28 and engaged with axial ends of the outer flexible skin 26.

Referring to FIG. 1, the outer flexible skin 26 has openings for receiving the drains 30 through which formation fluid is collected when the outer flexible skin 26 is expanded against a surrounding wellbore wall. The drains 30 may be embedded radially into the outer flexible skin 26. A plurality of the flow lines 36 may be operatively coupled with the drains 30 for directing the collected formation fluid in an axial direction to one or both of the mechanical fittings 150. In an embodiment, the flow lines 36 are in the form of tubes, and the tubes are connected to the guard drains 34 and the sample drains 32 disposed between the guard drains 34. The tubes maintain separation between the fluids flowing into the guard drains 34 and the sample drains 32, respectively.

Figure 2:
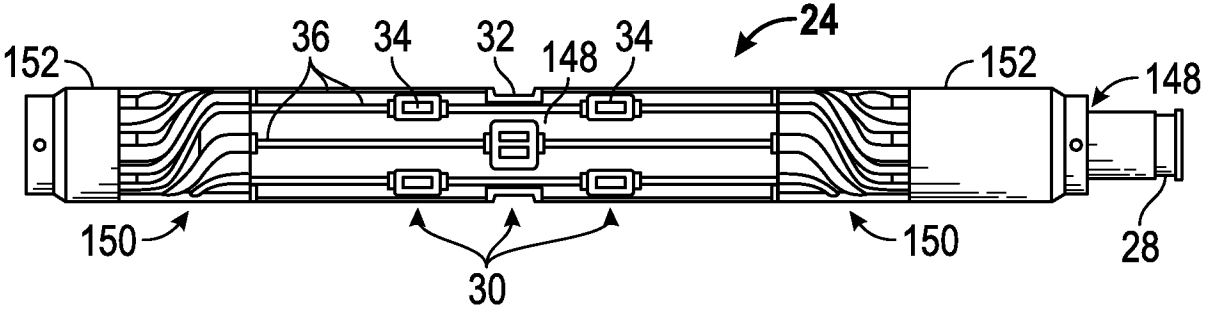
FIG. 2 (Prior Art)

As illustrated in FIG. 2, the flow lines 36 may be tubes/conduits oriented generally axially along the packer 24. The flow lines 36 extend through the axial ends of the outer flexible skin 26. By way of example, the flow line 36 may be at least partially embedded in the flexible material of the outer flexible skin 26. Consequently, the portions of the flow lines 36 extending along the outer flexible skin 26 move radially outward and radially inward during expansion and contraction of the packer 24. One or more mechanical fittings 150 may have collector portions 152 coupled with a plurality of movable members. The movable members are pivotably coupled to each of the collector portions 152 via pivot links for pivotable motion about an axis generally parallel with the packer axis. At least some of the movable members are designed as tubes to transfer fluid received from the flow lines 36, extending along the outer flexible skin 26, to collector portions 152. From the collector portions 152, the collected fluids may be transferred/directed to desired collection/testing locations. The pivotable motion of the movable members enable transition of the packer 24 between a contracted state and an expanded state. The movable members may be designed generally as S-shaped members pivotably connected between flow lines in the outer flexible skin 26 and the collector portions 152.

As described above, the packer assembly 20 may be constructed in a variety of configurations for use in many environments and applications. The packer 24 may be constructed from different types of materials and components for collection of formation fluids from single or multiple intervals within a single expansion zone. The flexibility of the outer flexible skin 26 enables use of the packer 24 in many well environments. Furthermore, the various packer components can be constructed from a variety of materials and in a variety of configurations as desired for specific applications and environments.

Figure 3:
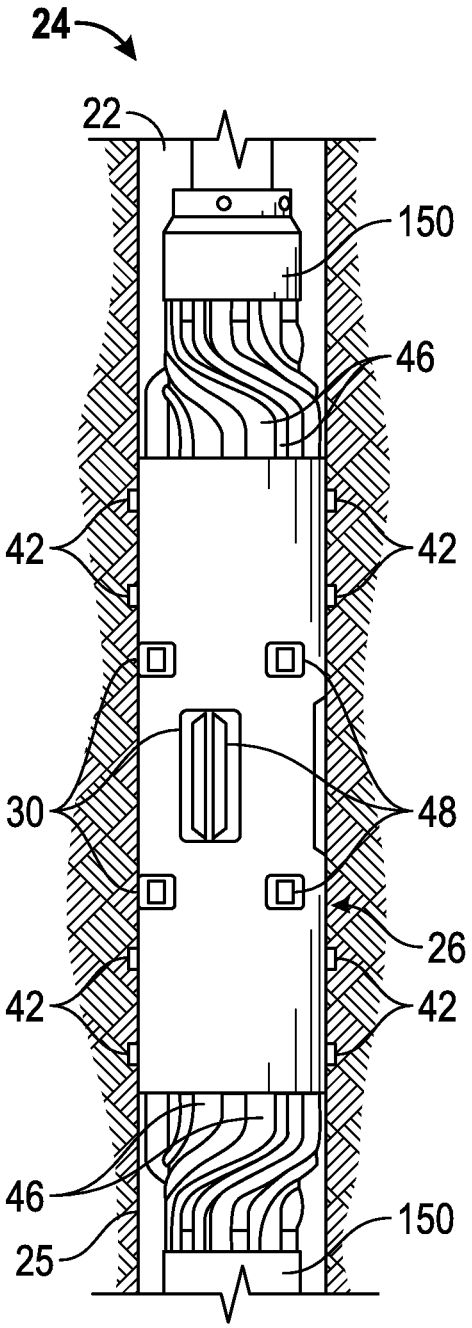
FIG. 3 (Prior Art)
FIG. 3 generally illustrates a packer deployed into a well system of the prior art.

FIG. 3 is a schematic of an example single packer 24 disposed in the wellbore 22 according to the prior art. The packer 24 is shown disposed into a wellbore 22 traversing a formation. The mechanical fittings 150 permit the selective extension and retraction of a seal 48 toward the wall 25 of the wellbore 22. The seal 48 prevents or reduces fluid flow between the wellbore 22 and the drains 30, while still permitting fluid flow between the formation and the drains 30. Each flowline 46 may be coupled to one or more of the drains 30, and may communicate with a pump and/or others components of a downhole testing tool (not shown). Thus, fluid may be drawn and/or injected between a downhole testing tool and the porous or fractured space in the formation. The single packer 24 may have sensors 42 to measure the pressure and the flow rate of the drawn and/or injected fluid. These sensors 42 may be implemented in the drains 30, such as shown by sensors 42; however, other sensors located along the flowlines 46 or beyond may be used.

The single packer 24 applies a compression load to the walls 25 of the wellbore 22, in part to assist the sealing function of the seal 48, but also to increase the level of mechanical stress in the formation near the wellbore 22. The compression load may be applied by increasing the pressure in an inflation bladder used to extend the seal 48; therefore, the compression load may be a uniform pressure. The compression load may also be applied by extension/retraction actuators (e.g., hydraulic pistons) coupled to one or more flowlines 46 at the mechanical fittings 150. Therefore, the compression load can be a linear force localized near the actuated flowlines 46. Capabilities of inflating the single packer 24 and pressing the flowline 46 against the formation may be used to independently adjust the seal 48 and the magnitude of the load applied to the formation.

The single packer 24 may have sensors 42 to determine the compression load applied to the walls 25 of the wellbore 22 and its repartition. For example, contact pressure sensors, inflation pressure, or actuation force (e.g., pressure in a hydraulic piston) applied to the flowlines 46 via the mechanical fittings 150 can be used to directly measure or infer the compression load applied to the walls 25 of the formation 22. The single packer 24 may also have sensors for determining the shape and/or the deformation of the wall 25 of the wellbore 22. For example, the internal rotation of movable members in one or both mechanical fittings 150 can be measured.

The location of the drains 30 in FIG. 3 shows one example of an arrangement of drains; however, any configuration of drains 30 may be used. The single packer 24 may be located between an upper conventional packer (not shown) and a lower conventional packer (not shown). The sealed intervals between the upper conventional packer and the single packer 24 and between the lower conventional packer and the single packer 24 may be hydraulically coupled to the downhole testing tool via ports.

Figure 4:
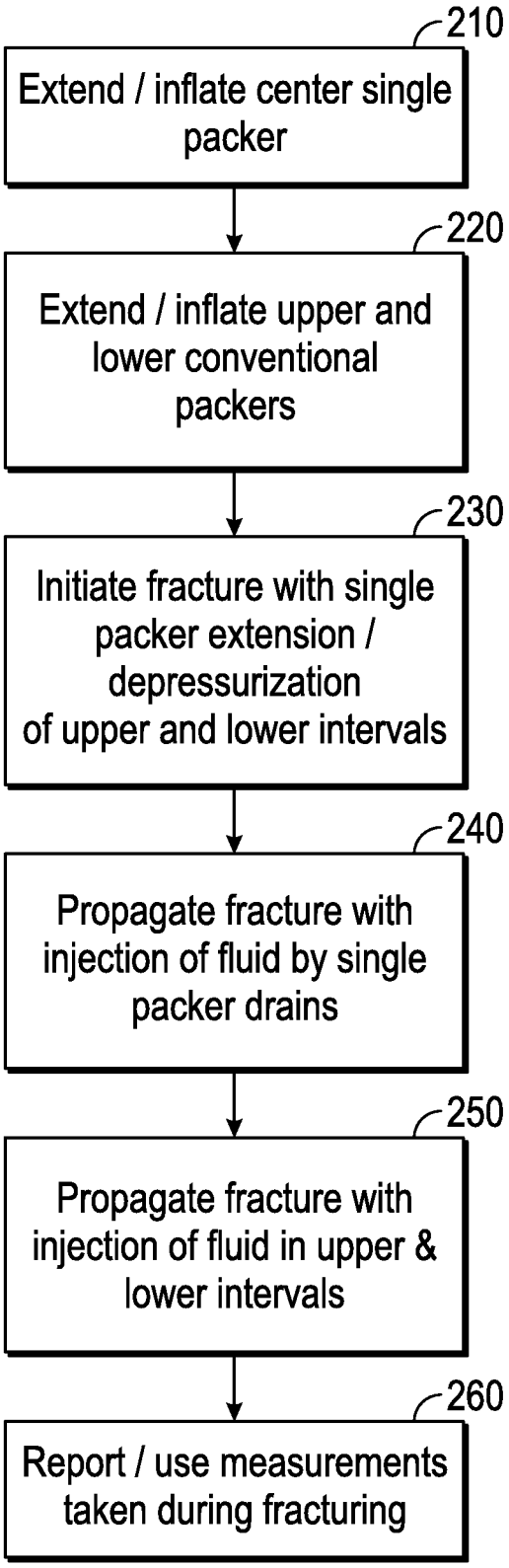
FIG. 4 is a flow chart of a method of determining formation stability, and design parameters of frac-pack operations in accordance with one or more aspects of the present disclosure.

FIG. 4 is a flow chart of a method of determining formation stability and design parameters of frac-pack operations. Beginning with step 210, a single packer, such as the single packer 24 of FIGS. 1-3, is inflated and applies a uniform pressure on the formation wall. Further, flowlines or other structures may extend and apply a localized force on the formation wall. The inflation pressure, the flowline extension force, and/or the contact pressure between the packer and the formation wall may be monitored concurrently with the fluid volume pumped into the packer and/or the internal rotation of movable members in one or both mechanical fittings. These measurements can be used to determine curves and/or tables indicative of the wellbore deformation as a function of the stress generated in the formation. By analyzing these curves or tables, formation rock stiffness, formation stress relaxation, or other formation rock characteristics may be estimated.

In step 220, the upper conventional packer and the lower conventional packer may be inflated to seal an interval straddling the single packer. Optionally, diverting fluids may be injected through the intervals above and/or below the single packer to reduce the loss of fluid injected into the formation by the central single packer. Then, in step 230, the pressure in the sealed intervals and the force applied by the single packer to the formation may be adjusted to initiate a fracture in the formation.

To promote the generation of fractures perpendicular to the wellbore axis, the sealed intervals may be depressurized, and the pressure applied by the single packer to the formation may be increased, so that large shear stresses are generated in the formation at the extremities of the single packer. To promote the generation of fractures parallel to the wellbore axis, the sealed intervals may be pressurized, and the linear force applied by the flowlines of the single packer to the formation may be increased. The pressurization and linear force generates large tensile stresses in the formation around the single packer. Optionally, the linear force may be applied by only the flowlines that are aligned with a particular section of the wellbore wall. Thus, the initiation of fractures may be selectively oriented in a particular direction.

Again, curves of the wellbore deformation as a function of the stress generated in the formation may be determined using, for example, the sensors 42 as previously discussed with regard to FIG. 3. The curves may be analyzed to estimate formation yield strengths, such as shear and/or tensile strength. These characteristics may be used to predict the depth of penetration of perforations that would be caused by different types and configurations of shaped charges. The characteristics may also be used to select a type and configuration of shaped charges that would meet some perforating objectives in the formation being tested.

Next, in step 240, parallel fractures may be hydraulically propagated by pumping wellbore fluid and/or fracturing fluid from the drains of the single packer and into the initiated fractures. Optionally, the fluid may be pumped from a particular subset of the drains of the single packer that are aligned with a particular section of the wellbore wall. Thus, the propagation of fractures may be selectively oriented in particular directions. The pumping pressure and/or the fluid flow rate may be monitored to determine the fracture propagation pressure as well as the permeability of the fractures. Also, the axial extent of these fractures may be estimated from the occurrence of pressure spikes in the sealed upper and lower intervals. The pressure spikes occur when the fracture extends beyond the sealed surface of the single packer. The azimuthal location and radial extent of the fractures may be estimated by monitoring the shape of the wellbore as fractures are extended into the wellbore, or are opened and/or closed by the pumped fluid.

Fractures may also be propagated by injection of fluid into the sealed upper and lower intervals. The fractures may be parallel or perpendicular to the drains. Other characteristics of the fractures that have been created with the single packer may also be measured using permeability imaging techniques such as, for example, those disclosed in U.S. Pat. No. 7,277,796 to Kuchuk et al., the contents of which are herein incorporated by reference. The measurements may be used to design frac-pack operations, such as generating the type of perforation need for fracking. Moreover, the pressure and flow rate required by the frac pumps during fracking may be determined as well. For example, measurements taken during initiation and/or propagation of fractures in selected directions around the wellbore can be used to improve formation treatment for improved producibility.

Figure 5:
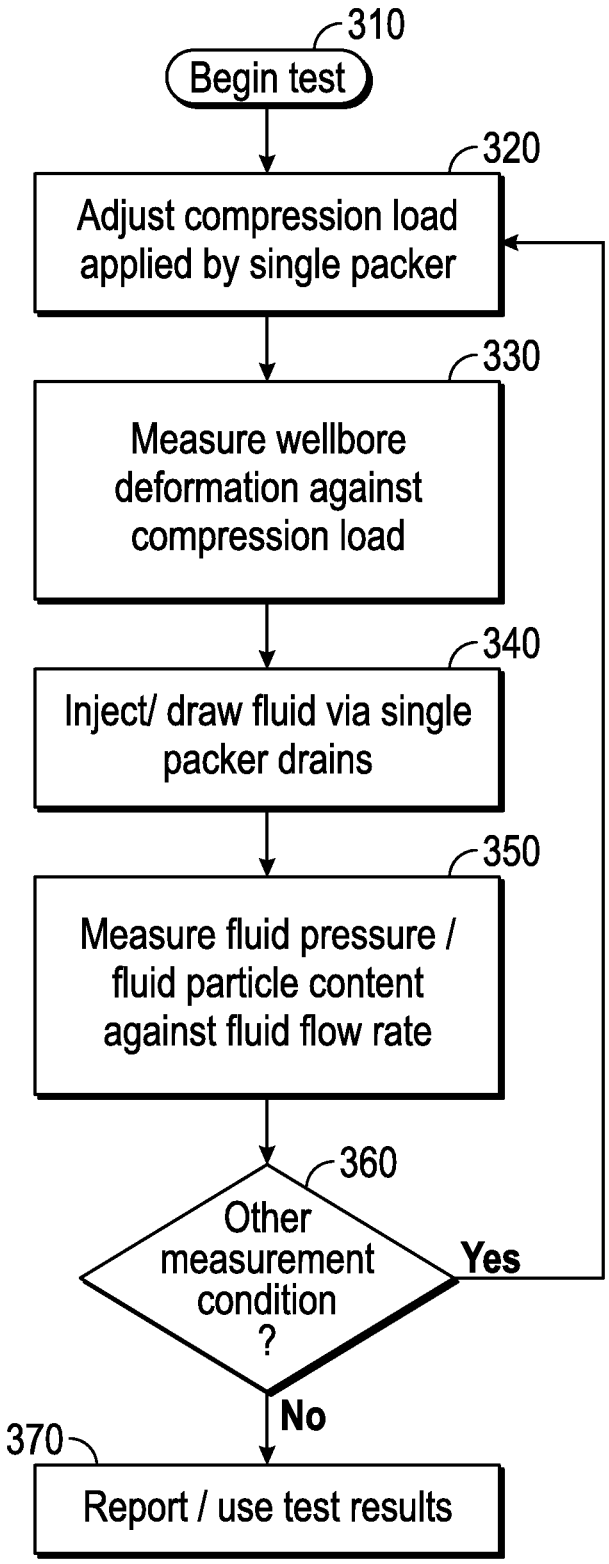
FIG. 5 is a flow chart of a method of iteratively taking measurements over varying compression loads in accordance with one or more aspects of the present disclosure.

FIG. 5 is a flow chart of a method of determining sand production as a function of consolidation/compaction, and design parameters for gravel pack operations. The test is initiated in step 310. In step 320, the compression load applied by the single packer is iteratively adjusted by changing the inflation pressure of the single packer. In step 330, the wellbore deformation is measured against the compression load. For the different levels of compression load, formation fluid may be drawn or injected at different rates through the drains of the single packer in step 340. In step 350, the resulting pressure, sand content and/or other fluid properties may be measured using a fluid analyzer coupled to the drains. In step 360, if other measurement conditions are desired, then steps 320 through 350 are repeated. If not, the measurements are reported and/or used in step 370. Such other measurement conditions may be, for example, increasing levels of compression load applied by the packer.

The measurements may be used to determine curves and/or tables which may be indicative of produced sand as a function of fluid flow rate and consolidation load. These measurements may also be used to determine curves or tables indicative of formation permeability as a function of consolidation load. These curves and/or tables may be introduced into a formation model to determine a level of consolidation of the formation that may sufficiently limit the production of sand by the formation for a particular production rate. This consolidation level may then be used to design a gravel pack completion. Furthermore, the method permits measuring the shape of the formation wall as the single packer is expanded. The measuring of wall shape may be used to identify caved or ovalized zones of the wellbore in which gravel pack completion may be more challenging.

Figure 6A:
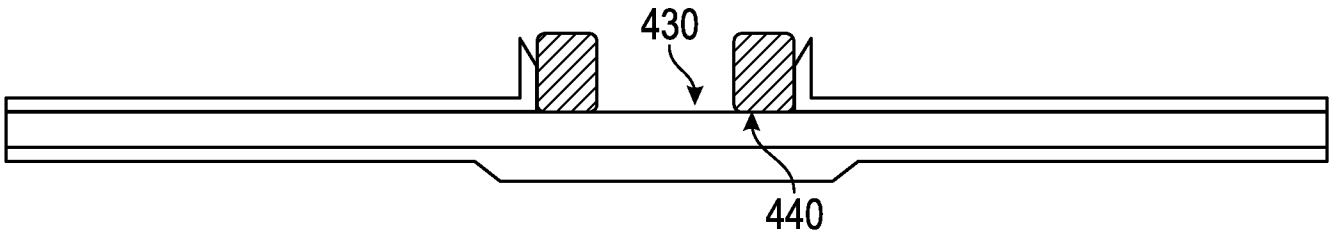
FIG. 6A shows a cross sectional view of a sampling inlet that may be used to carry out methods in accordance with one or more aspects of the present disclosure.
Figure 6B:
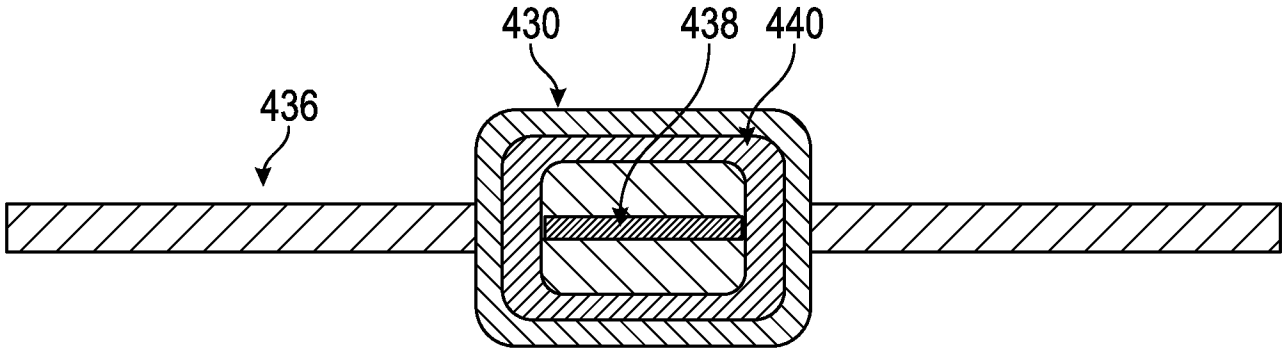
FIG. 6B shows a top plan view of a sampling inlet that may be used to carry out methods in accordance with one or more aspects of the present disclosure.

FIGS. 6A and 6B show a sampling inlet that may be used to carry out methods in accordance with one or more aspects of the present disclosure. A single packer configuration, such as the single packer 24 described in FIGS. 1 through 3, is typically used for sampling. However, as described with respect to FIGS. 4 and 5, the single packer may be used for pressure testing as well. Due to the sealing required for pressure testing, a drain 430 for a single packer is provided with a sealing pad 440. The sealing pad 440 may be composed of rubber to enhance sealing properties. The sealing pad 440 may form a contiguous rectangular shape around the exterior of the drain 430 or may be other shapes. The drain 430 may be a guard drain and/or a sample drain, such as the guard drains 34 and sample drains 32 described in FIGS. 1 through 3. The drain 430 is in fluid communication with a flowline 436. The interior of the drain 430 has an opening 438 in the flowline. It should be noted that the drain 430 is not restricted to pressure testing. The drain 430 may also be used on a single packer to conduct regular operations, such as fluid sampling.

Figure 7:
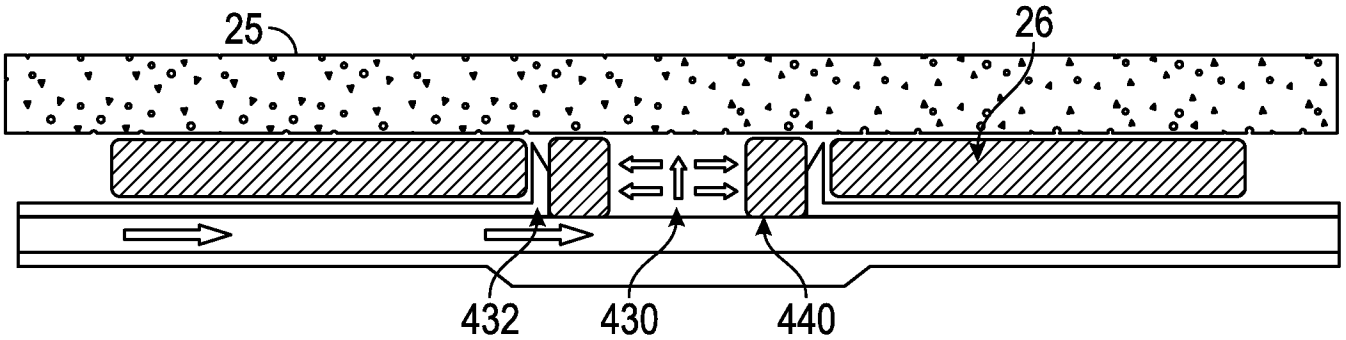
FIG. 7 shows a cross sectional view of the drain of FIGS. 6A and 6B abutted to a formation wall.

FIG. 7 shows the drain 430 of FIGS. 6A and 6B abutted to the formation wall 25. The drain 430 has a rigid outer rim 432 within which the sealing pad 440 is disposed. The rim 432 prevents the sealing pad 440 from lateral deformation due to increased stress. Thus, the sealing pad 440 may not be directly connected to the outer flexible skin 26 of the single packer.

When abutted to a formation wall 25 upon expansion of the packer, the sealing pad 440 of the drain 430 forms a leak-proof seal with the wall 25. Upon forming the seal, fluid may be injected into and/or drawn from the formation. During fluid exchange, pressure measurements may be taken. The seal ensures that no air or fluid leaks from the drains so that the pressure measurements are accurate. Furthermore, a sensor (not shown) may be disposed in or around the drain for making other measurements. The sensor may be, for example, a fluid analyzer. The fluid analyzer may measure sand content and/or other fluid properties.

In the embodiments described above where a component is described as formed of rubber or comprising rubber, the rubber may include an oil resistant rubber, such as NBR (Nitrile Butadiene Rubber), HNBR (Hydrogenated Nitrile Butadiene Rubber) and/or FKM (Fluoroelastomers). In a specific example, the rubber may be a high percentage acrylonytrile HNBR rubber, such as an HNBR rubber having a percentage of acrylonytrile in the range of approximately 21% to approximately 49%. Components suitable for the rubbers described in this paragraph include, but are not limited to, the outer flexible skin 26, the inflatable bladder 148, and the sealing pad 440.

Although exemplary systems and methods are described in language specific to structural features and/or methodological acts, the subject matter defined in the appended claims is not necessarily limited to the specific features or acts described. Rather, the specific features and acts are disclosed as exemplary forms of implementing the claimed systems, methods, and structures. Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

We claim:

1. A method comprising:

deploying a packer into a formation;

inflating the packer against a wall of the formation until fractures are initiated in the wall;

propagating the fractures by pumping fluid into the fractures from drains disposed on the packer; and measuring data related to the formation.

2. The method of claim 1, further comprising:

applying a uniform pressure onto the wall of the formation.

3. The method of claim 1, further comprising:

extending flowlines of the packer to initiate fractures in the wall.

4. The method of claim 1 wherein the data is an inflation pressure of the packer.

5. The method of claim 1 wherein the data is a contact pressure between the packer and the wall of the formation.

6. The method of claim 1 wherein the data is the fluid volume pumped into the formation.

7. The method of claim 1, further comprising:

analyzing the data to determine characteristics of the formation.

8. The method of claim 1 wherein each of the drains has a elastomeric pad for creating a seal between the drain and a wall of the formation.

9. The method of claim 1, comprising deploying the packer between an upper packer and a lower packer, wherein the packer comprises a single packer.

10. The method of claim 8, wherein each of the drains comprises a rigid outer rim within which the elastomeric pad is disposed, and the elastomeric pad is not coupled to an outer flexible skin of the packer.

11. A method comprising:

deploying a single packer between an upper packer and a lower packer in a wellbore;

expanding the upper packer and the lower packer to isolate an interval of the wellbore in which the single packer resides after deploying the single packer;

depressurizing the isolated interval after expanding the upper and lower packers;

expanding the single packer to initiate fractures in a wall of the wellbore after depressurizing the isolated interval; and propagating the fractures by pumping fluid into the fractures from drains disposed on the single packer.

12. The method of claim 11 further comprising:

repressurizing the isolated interval.

13. The method of claim 11 further comprising:

monitoring a pressure of the pumped fluid.

14. The method of claim 11 further comprising:

monitoring the fractures using permeability imaging techniques.

15. The method of claim 11 wherein the single packer has drains further having an elastomeric pad for creating a seal between the drain and a wall of the formation.

16. A method comprising:

expanding a packer against a wall of a wellbore until a first compression load is applied the first compression load being sufficient to initiate fractures in the wall of the wellbore;

deforming the wall of the wellbore via expansion of the packer;

measuring deformation of the wall of the wellbore under the first compression load;

exchanging fluid between the packer and the wall via drains disposed on the packer; propagating the fractures by pumping fluid through the drains and measuring data related to the formation during the exchanging of fluid.

17. The method of claim 16, further comprising:

adjusting the packer until a second compression load is applied; and repeating the steps of measuring deformation, exchanging fluid, and measuring data.

18. The method of claim 16 wherein the data is sand content.

19. The method of claim 16 wherein the data is measured as a function of a flow rate of the fluid.

* * * * *